US009494144B2

(12) United States Patent
Nathan

(10) Patent No.: US 9,494,144 B2
(45) Date of Patent: Nov. 15, 2016

(54) PISTON PUMP FOR A HIGH-PRESSURE CLEANING APPLIANCE

(71) Applicant: Alfred Kärcher GmbH & Co. KG, Winnenden (DE)

(72) Inventor: Robert Nathan, Backnang (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 0 days.

(21) Appl. No.: 14/334,113

(22) Filed: Jul. 17, 2014

(65) Prior Publication Data

US 2014/0328699 A1 Nov. 6, 2014

Related U.S. Application Data

(63) Continuation of application No. PCT/EP2012/050876, filed on Jan. 20, 2012.

(51) Int. Cl.

| | |
|---|---|
| ***F04B 53/16*** | (2006.01) |
| ***F04B 1/20*** | (2006.01) |
| ***F04B 17/03*** | (2006.01) |
| ***F04B 39/12*** | (2006.01) |
| ***F04B 53/22*** | (2006.01) |

(52) U.S. Cl.

CPC ..... *F04B 1/2078* (2013.01); *F04B 17/03* (2013.01); *F04B 39/125* (2013.01); *F04B 53/16* (2013.01); *F04B 53/22* (2013.01)

(58) Field of Classification Search

CPC ..... F04B 17/03; F04B 1/2078; F04B 53/22; F04B 53/16; F04B 39/122; F04B 39/125; F16M 7/00; F16L 3/02; F24J 2/52

See application file for complete search history.

(56) References Cited

U.S. PATENT DOCUMENTS

| | | | | |
|---|---|---|---|---|
| 36,622 | A * | 10/1862 | Rhoades | 417/524 |
| 2,146,709 | A | 2/1939 | Bird et al. | |
| 3,323,461 | A | 6/1967 | Bennett | |
| 6,092,998 | A | 7/2000 | Dexter et al. | |
| 6,206,664 | B1 * | 3/2001 | Kakizawa | 417/569 |
| 6,474,958 | B2 * | 11/2002 | Nathan | 417/269 |

(Continued)

FOREIGN PATENT DOCUMENTS

| | | |
|---|---|---|
| DE | 44 45 519 | 6/1996 |
| DE | 195 48 498 | 7/1997 |
| DE | 198 59 336 | 6/2000 |
| DE | 10 2005 050 009 | 4/2007 |

(Continued)

*Primary Examiner* — Peter J Bertheaud
*Assistant Examiner* — Dnyanesh Kasture
(74) *Attorney, Agent, or Firm* — Womble Carlyle Sandridge & Rice LLP

(57) ABSTRACT

A piston pump for a high-pressure cleaning appliance is provided, including a pump block having a plurality of pump chambers, into each of which one piston plunges, and including a pump head having a suction inlet and a pressure outlet, each pump chamber in flow connection via a suction valve with the suction inlet and via a pressure valve with the pressure outlet, and including a clamping bracket engaging around the pump head. The piston pump can have a single U-shaped clamping bracket oriented symmetrically in relation to the longitudinal pump axis, and the pump head and the pump block form between them downstream of the pressure valves a pressure chamber in which a central, piston-like insert part is arranged, the insert part being surrounded by a sealing element and having a passage, and a pressure line oriented coaxially with the longitudinal pump axis being arranged downstream of the passage.

14 Claims, 4 Drawing Sheets

(56) References Cited

U.S. PATENT DOCUMENTS

| | | | | |
|---|---|---|---|---|
| 8,790,092 | B2 | 7/2014 | Mueller et al. | |
| 2009/0214367 | A1* | 8/2009 | Brabek et al. | 417/559 |
| 2011/0027106 | A1 | 2/2011 | Ochiai | |
| 2011/0189031 | A1 | 8/2011 | Zhang | |
| 2012/0211034 | A1 | 8/2012 | Nathan et al. | |

FOREIGN PATENT DOCUMENTS

| | | |
|---|---|---|
| DE | 10 2007 020 299 | 10/2008 |
| DE | 10 2007 020 300 | 10/2008 |
| WO | WO 2008/086950 | 7/2008 |
| WO | WO 2008/128591 | 10/2008 |

* cited by examiner

PISTON PUMP FOR A HIGH-PRESSURE CLEANING APPLIANCE

CROSS-REFERENCE TO RELATED APPLICATIONS

This application is a continuation of international application number PCT/EP2012/050876, filed on Jan. 20, 2012, which is incorporated herein by reference in its entirety and for all purposes.

BACKGROUND OF THE INVENTION

The invention relates to a piston pump for a high-pressure cleaning appliance, comprising a pump block having a plurality of pump chambers, into each of which one piston which is movable back and forth parallel to a longitudinal pump axis plunges, and comprising a pump head fitted on the pump block and having a suction inlet for supplying liquid and a pressure outlet for discharging liquid, each pump chamber being in flow connection via a suction valve with the suction inlet and via a pressure valve with the pressure outlet, and comprising a clamping bracket engaging around the pump head for clamping the pump head to the pump block.

By means of such piston pumps, a liquid, preferably water, can be pressurized and delivered via a pressure hose to a discharge device, for example, a spray lance or spray nozzle. This makes it possible to direct the pressurized liquid onto an article or a surface in order to clean the article or the surface. The pressure of the liquid may be significantly more than 100 bar. Therefore, the piston pump must have a considerable degree of mechanical stability. On the other hand, it should be possible to produce and assemble the piston pump as cost-effectively as possible. In DE 195 48 498 A1, it is, therefore, proposed that the pump head be produced from a plastic material and clamped by means of a clamping element to the pump block. In this case, the clamping element is constructed as a hood with a large number of bridges extending at an incline to the longitudinal pump axis, and with a connection pipe into which the pressure outlet of the pump head, which is constructed as pressure connection piece, extends. In addition, the clamping element comprises a support flange which lies against a step of the pressure connection piece and from which the bridges extend at an incline to the longitudinal pump axis in the direction of the pump block. The clamping element, therefore, has an elaborate construction which involves not inconsiderable production costs. During assembly of the piston pump, care must be taken to ensure that the support flange of the clamping element lies with surface-to-surface contact on the corresponding step of the pressure connection piece of the pump head.

A piston pump of the kind mentioned at the outset is proposed in DE 195 59 336 C1. In this piston pump, use is made of a clamping element with two U-shaped clamping brackets which are connected to each other by a rigid connecting part. The connecting part has a through-bore through which the pressure connection piece passes. The two U-shaped clamping brackets each have two limbs, which are connected to each other by a bridge. The bridges of the clamping brackets lie offset from the longitudinal pump axis in each case against the end face of the pump head.

There is known from WO 2008/128591 A1 a piston pump, in which the pump head has tension rods which extend over the pump block in the axial direction and are releasably connectable to a pump drive, the pump block being clamped between the pump head and the pump drive. In this piston pump, a separate clamping element can be dispensed with. Instead, a pump head with a special shape is used.

The object of the present invention is to develop a piston pump of the kind mentioned at the outset in such a way that it can be produced more cost-effectively and assembled more easily.

SUMMARY OF THE INVENTION

This object is accomplished, in accordance with the invention, in a piston pump of the generic kind in that the piston pump has a single U-shaped clamping bracket which is oriented symmetrically in relation to the longitudinal pump axis, and in that the pump head and the pump block form between them downstream of the pressure valves a pressure chamber in which a central, piston-like insert part is arranged, the insert part being surrounded by at least one sealing element and having a passage, and a pressure line oriented coaxially with the longitudinal pump axis being arranged downstream of the passage.

Surprisingly, it has been found that the pump head can be clamped to the pump block by means of a single U-shaped clamping bracket without the mechanical stability of the piston pump being affected, provided the clamping bracket is arranged symmetrically in relation to the longitudinal pump axis and between the pump block and the pump head a pressure chamber is provided, in which a central insert part in the fashion of a piston, surrounded by at least one sealing element, is arranged, the pressure chamber being arranged downstream of the pressure valves and upstream of a pressure line oriented coaxially with the longitudinal pump axis. During operation of the piston pump, the pressurized liquid in the pressure chamber upstream of the insert part forms a hydraulic ram which acts upon the pump block with an axially oriented force which counteracts the forces and torques exerted by the pistons on the pump block, so that use of a single U-shaped clamping bracket is sufficient to impart the necessary stability to the piston pump.

The longitudinal pump axis can pass through the center of a bridge of the clamping bracket, and the limbs of the clamping bracket can be oriented symmetrically in relation to the longitudinal pump axis. Use of a single U-shaped clamping bracket makes particularly cost-effective production and assembly of the piston pump possible. To fix the clamping bracket, only two connecting elements, which engage the free ends of the limbs of the clamping bracket, for example, two connecting screws, are required.

The pump head and/or the pump block are preferably produced from a plastic material. This makes it possible to additionally reduce the production costs.

In an advantageous embodiment of the invention, the pressure chamber is constructed rotationally symmetrically in relation to the longitudinal pump axis.

The pressure chamber is preferably of cylindrical configuration, at least in a partial area thereof.

In an advantageous embodiment, the pistons of the piston pump are uniformly distributed around the longitudinal pump axis and are arranged at an identical radial distance from the longitudinal pump axis. For example, it may be provided that the piston pump comprises three pump chambers, into each of which one cylindrical piston plunges. The longitudinal piston axes are oriented parallel to the longitudinal pump axis and are arranged at the corner points of an equilateral triangle.

The arrangement of the pistons at an identical radial distance from the longitudinal pump axis and at a constant angular distance from one another makes it easier to compensate occurring forces and torques by means of the hydraulic ram forming during operation of the piston pump in the pressure chamber in the form of the liquid flowing into the pressure chamber and by means of the U-shaped clamping bracket engaging around the pump head in a central plane.

In a particularly cost-effective configuration of the invention, the pressure valves each have a pressure valve spring which is supported on the central insert part. In such a configuration, the central insert part forms a valve holder on which the pressure valve springs are supported. The pressure valve springs each exert a closing force on a closing member in the direction towards a pressure valve seat.

The central insert part has a passage, and the pressure line extends downstream of the passage. The pressure line expediently forms a connection between the passage of the insert part and the pressure outlet of the piston pump.

The passage of the central insert part is expediently oriented coaxially with the longitudinal pump axis.

It is expedient for the central insert part to form a valve seat on which a closing member of a central check valve is sealingly positionable. For this purpose, the central insert part can have at its front side facing away from the pressure valves a recess which receives and guides the closing member of the central check valve.

In a preferred embodiment of the invention, the pistons are arranged outside of an axial projection of the insert part. In this context, an axial projection of the insert part is to be understood as a projection of the insert part in the direction of the longitudinal pump axis. It has been found that the pump block can withstand the pressure forces and torques exerted by the pistons particularly reliably if the pistons are positioned outside of an axial projection of the central insert part. The diameter of the insert part in the area of a sealing element surrounding it and arranged between the insert part and the wall of the pressure chamber defines the surface area with which the insert part acts during operation of the piston pump on the liquid located upstream of the insert part in the pressure chamber. This pressurized liquid forms a hydraulic ram which is pressed by the insert part against the pump block. This pressing force counteracts the pressure forces and torques exerted by the pistons during operation of the piston pump. An effective compensation of the pressure forces and torques can be achieved by the positioning of the pistons outside of the axial projection of the central insert part explained above.

It is advantageous for the pressure surface of the central insert part facing the pump block to be at least three times larger than the end faces of the pistons plunging into the pump chambers. The surface of the insert part exerting a pressure on the liquid located in the pressure chamber is referred to as pressure surface. For example, it may be provided that the pistons and the central insert part are of circular configuration, the diameter of the pressure surface of the insert part being about twice as large as the diameter of the pistons.

It is advantageous for the piston pump to have a pressure connection piece which is oriented coaxially with the longitudinal pump axis and passes through the center of a bridge of the clamping bracket. The clamping bracket has a bridge which joins the limbs of the clamping bracket. The bridge can surround the pressure connection piece in the circumferential direction and thereby be supported in the axial direction. To assemble the piston pump, the U-shaped clamping bracket can be fitted unto the pressure connection piece. This facilitates the positioning of the clamping bracket.

It is particularly advantageous for the pump head to be adapted to be acted upon in the axial direction by an elastic resetting force which counteracts the clamping force exerted by the clamping bracket. This makes it possible to move the pump head slightly during operation of the piston pump in the axial direction relative to the pump block in accordance with the stroke movement of the pistons. This has the consequence that the central insert part can be supported in the axial direction on the pump head and, when pressure peaks occur, can execute together with the pump head in the axial direction a movement relative to the pump block. A rigid coupling between pump block and pump head can be avoided by use of the elastic resetting force counteracting the clamping force. Rather, the elastic resetting force makes a compensatory movement between the pump block and the pump head possible.

It may, for example, be provided that an elastically deformable element is arranged between the pump head and the pump block. When assembling the piston pump, the pump head can be fitted onto the pump block with the interposition of the elastically deformable element. The pump head can then be clamped to the pump block by means of the clamping bracket. During operation of the piston pump, the elastically deformable element arranged between the pump head and the pump block allows slight axial compensatory movements of the pump head without the mechanical stability of the piston pump being affected.

In an advantageous embodiment, the elastically deformable element is configured as a sealing ring which is arranged between the pump head and the pump block.

In a further development of the invention, the piston pump has a piston guide device on which the pump block is fitted, the pump block being clamped by means of the clamping bracket between the pump head and the piston guide device. The pistons can be guided in the axial direction by means of the piston guide device. For this purpose, the piston guide device can comprise guide sleeves which each surround a piston in the circumferential direction.

The clamping bracket is preferably releasably connected, preferably, screwed, to the piston guide device. In such a configuration of the invention, the piston guide device forms an abutment for the clamping bracket which engages around and clamps the pump head and the pump block to the piston guide device.

For driving the pistons, the piston pump has, in an advantageous embodiment, a swash plate, with which the pistons interact, and which is arranged in a swash plate housing, the piston guide device being fitted on the swash plate housing.

The piston guide device preferably has a guide shield which forms a cover for the swash plate housing, and a support shield which is clamped by means of the clamping bracket between the guide shield and the pump block and which supports in the axial direction sealing elements surrounding the pistons in the circumferential direction. In such an embodiment, the piston guide device is of two-part construction and comprises a guide shield and a support shield which can be fitted thereon. The guide shield forms a cover for the swash plate housing and comprises guide members, for example, guide sleeves, which guide the pistons in the axial direction.

The clamping bracket is preferably screwed to the guide shield.

To prevent unintentional issue of pressurized liquid from the pump chambers, the pistons are each surrounded by a sealing element. The sealing elements are supported in the axial direction on the support shield of the piston guide device. For this purpose, the support shield can comprise support rings which surround the pistons and each support a sealing element in the axial direction. All of the support rings can be integrally connected to one another. This facilitates assembly of the piston pump.

The following description of a preferred embodiment of the invention serves for further explanation in conjunction with the drawings.

DETAILED DESCRIPTION OF THE INVENTION

Figure 3:
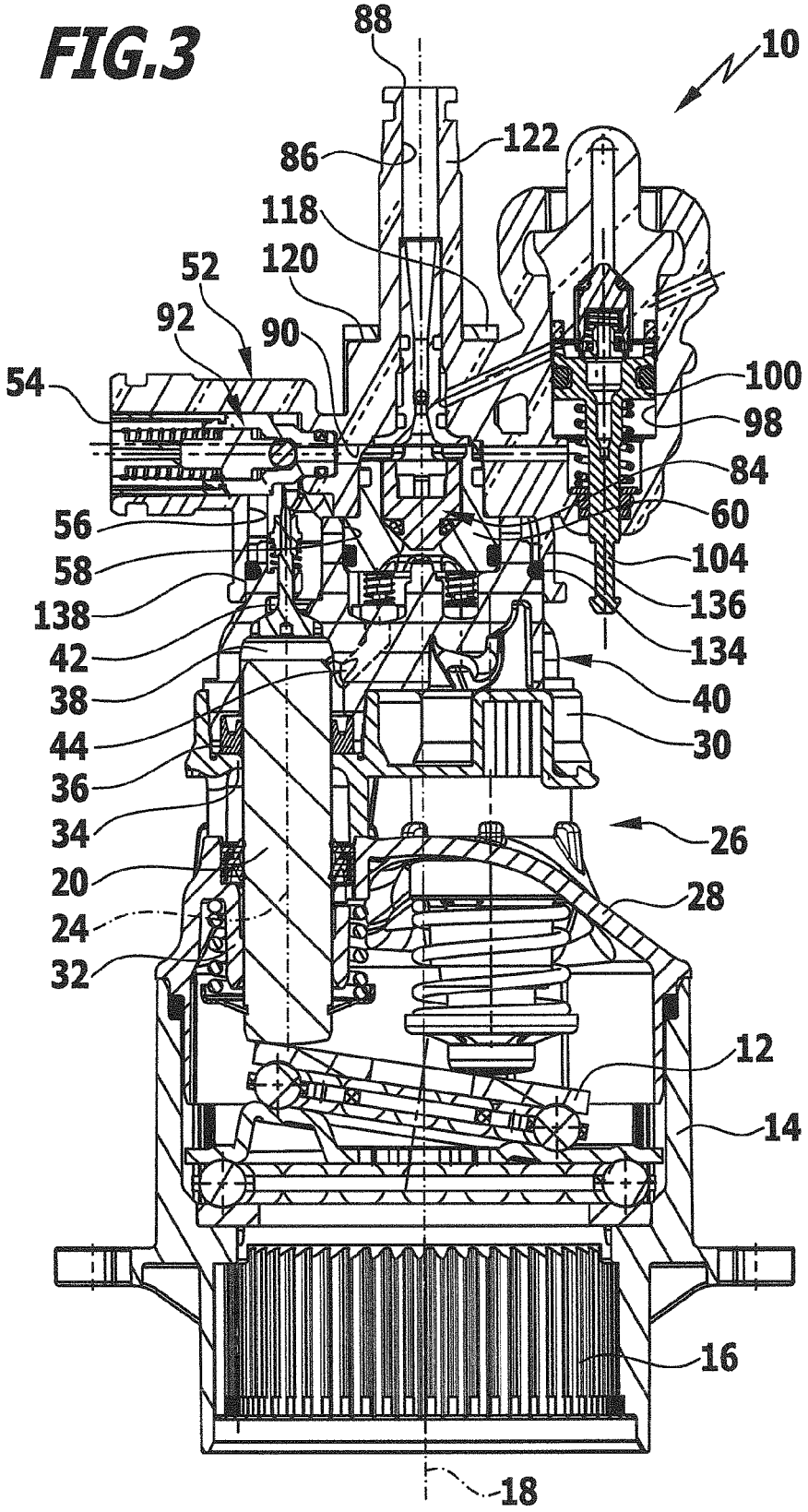
FIG. 3 shows a sectional view of the piston pump along line 3-3 in FIG. 2.

A preferred embodiment of a piston pump in accordance with the invention, generally denoted by reference numeral 10, is shown schematically in the drawings. As is evident from FIG. 3, the piston pump 10 comprises a swash plate 12, which is arranged in a swash plate housing 14 and which can be made to rotate by a drive motor, for example, an electric motor (not shown) via a gearing 16, known per se to one skilled in the art and shown only schematically, about a longitudinal pump axis 18.

A total of three pistons of identical configuration lie against the swash plate 12. One piston 20 is shown in a longitudinal section in the drawings. All of the pistons are oriented with their longitudinal piston axis 24 parallel to the longitudinal pump axis 18. The pistons 20 of the piston pump 10 are arranged so as to be uniformly distributed around the longitudinal pump axis 18 and are each at the same radial distance from the longitudinal pump axis 18.

A two-part piston guide device 26 comprising a guide shield 28 and a support shield 30 is fitted on the swash plate housing 14. The guide shield 28 forms a cover for the swash plate housing 14 and is convexly outwardly curved. It comprises guide members in the form of guide sleeves 32, through each of which a piston 20 passes and which guide the piston 20 in the axial direction.

The support shield 30 is fitted on the guide shield 28. The support shield 30 comprises support rings 34 which each surround a piston 20 in the circumferential direction and are integrally connected to one another. The support rings 34 each support a sealing ring 36 in the axial direction, which surrounds a piston 20 in the circumferential direction and by way of a sealing lip lies against this piston.

The pistons 20 of the piston pump 10 each plunge into a pump chamber 38 of a pump block 40 fitted on the support shield 30. The pump chambers 38 each have an inlet 42 and an outlet 44. A suction valve 46 is arranged at the inlet 42, and the outlet 44 is connected to a pressure valve 50 via an outlet line 48 shown in a dashed line in FIG. 3.

A pump head 52 which, like the pump block 40 and the support shield 30, is made of a plastic material is fitted on the pump block 40. The pump head 52 has a suction inlet 54 to which a suction line 56 is connected, which is in flow connection with the pump chambers 38. Liquid to be pressurized, preferably water, can, therefore, be supplied to all of the pump chambers 38 via the suction inlet 54 and the suction line 56.

The pump block 40 and the pump head 52 form between them a central pressure chamber 58 in which a central insert part 60 constructed in the fashion of a piston is arranged. The central pressure chamber 58, in its area accommodating the insert part 60, like the central insert part 60, is formed rotationally symmetrically in relation to the longitudinal pump axis 18. The insert part 60 has in the longitudinal direction approximately at the center a radially inwardly directed step 61, so that the area of the central insert part 60 extending into the pump block 40 has a larger outer diameter than the area of the insert part 60 extending into the pump head 52. In the area of the pump block 40, the central insert part 60 is surrounded in the circumferential direction by a first sealing ring 62, and in the area of the pump head 52, the central insert part 60 is surrounded in the circumferential direction by a second sealing ring 64. The two sealing rings 62, 64 are each arranged in an annular groove of the central insert part 60 and seal the central insert part 60 off from the wall of the pressure chamber 58. In the area of its step 61, the central insert part 60 is supported in the axial direction on the pump head 52.

The insert part 60 has in alignment with the longitudinal pump axis 18 a passage 66, and upstream of the passage 66 the outlet lines 48 of the pump chambers 38 open into the pressure chamber 58. A total of three pressure valves, each associated with an outlet line 48, are arranged in the pressure chamber 58. The pressure valve 50 is evident from the drawings. The pressure valves 50 are of identical construction and each comprise a pressure valve closing member 72 which is pressed by a pressure valve spring 74 against the mouth of an outlet line 48 opening into the pressure chamber 58. The pressure valve springs 74 are supported, on the one hand, on the respective pressure valve closing member 72 and, on the other hand, on the central insert part 60.

At its front side 78 facing the pump head 52, the insert part 60 has a rotationally symmetrical recess 80, oriented coaxially with the longitudinal pump axis 18, in which a closing member 82 of a central check valve 84 is arranged. The closing member 82 can be pressed in the axial direction against the insert part 60 by means of a closing spring, known per se to one skilled in the art and not shown in the drawings, and thereby close the passage 66 of the insert part 60.

Connected to the pressure chamber 58 in the pump head 52 is a pressure line 86 which is oriented coaxially with the longitudinal pump axis 18 and connects the pressure chamber 58 to a pressure outlet 88.

Immediately downstream of the central check valve 84, a bypass line 90, in which a bypass valve 92, known per se and, therefore, shown only schematically in the drawings, is arranged, branches off from the pressure line 86. The bypass line 90 connects the pressure line 86 to the suction line 56.

An injector 94, which forms a constriction of the flow cross section of the pressure line 86 is inserted in the usual manner in the pressure line 86. At the point of the narrowest flow cross section, there branches off from the pressure line 86 a first branch line 96, via which the area of the narrowest flow cross section of the pressure line 86 is connected to a rotationally symmetrical control chamber 98 oriented parallel to the longitudinal pump axis 18. A control piston 100 is held in the control chamber 98 for displacement parallel to the longitudinal pump axis 18. Connected to the control piston 100 is a switch plunger 104, which faces away from the first branch line 96 and passes through an opening in the pump head 52. With its free end, the switch plunger 104 interacts with a switch device, known per se, and, therefore, for better clarity, not shown in the drawings, in order to switch on and off the drive motor of the piston pump 10.

At the level of the switch plunger 104, a second branch line 108 runs from the control chamber 98 to the pressure line 86 and opens into the pressure line 86 upstream of the injector 94.

A connecting nipple 110 opens into the area of the control chamber 98 that faces away from the switch plunger 104. A chemical line can be connected to the connecting nipple 110 in order to add a cleaning chemical to the pressurized liquid flowing through the injector 94.

Figure 1:
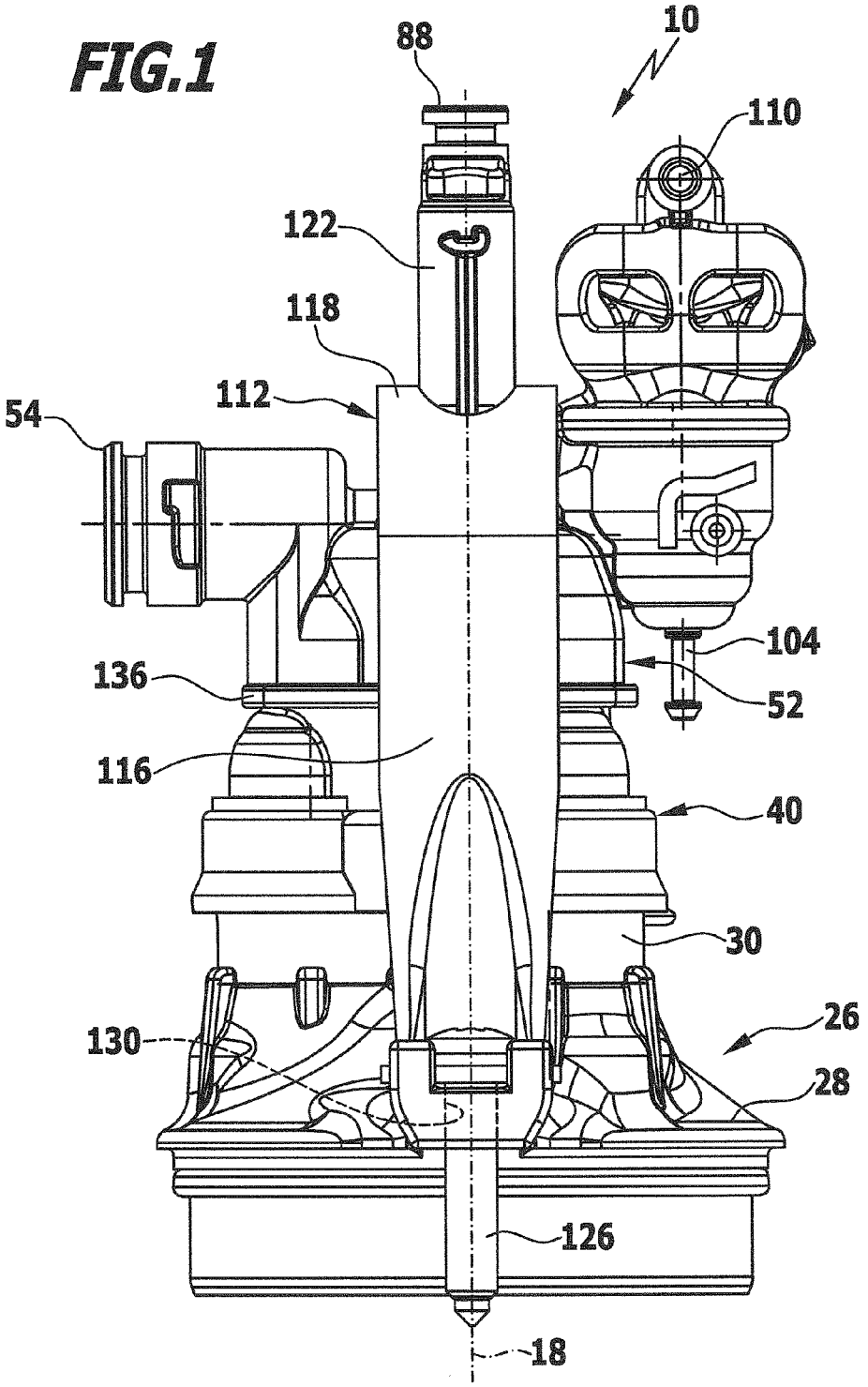
FIG. 1 shows a first side view of a preferred embodiment of a piston pump in accordance with the invention.
Figure 2:
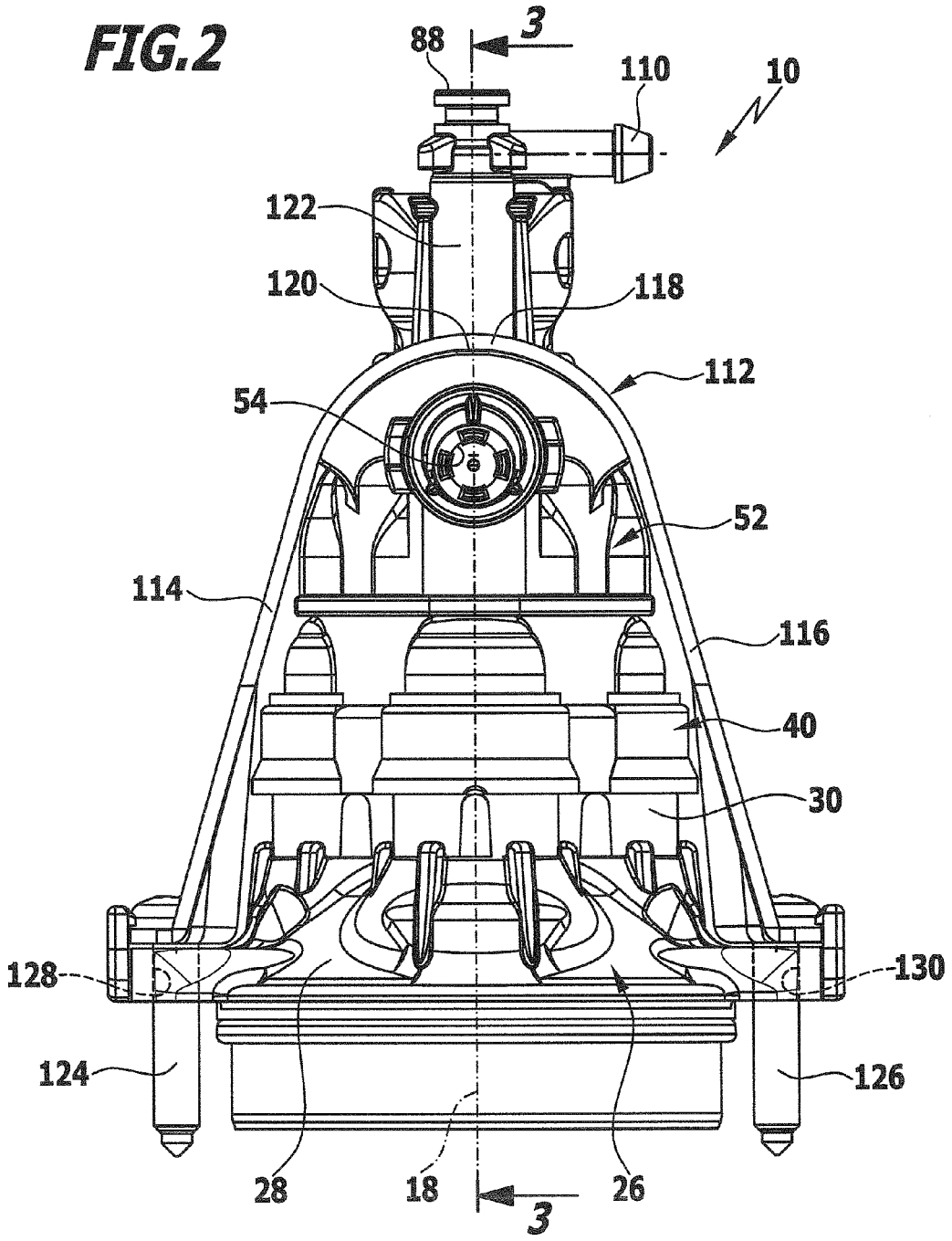
FIG. 2 shows a second side view of the piston pump shown in FIG. 1.

As is evident, in particular, from FIGS. 1 and 2, the piston pump 10 comprises a single clamping element in the form of a U-shaped clamping bracket 112, which has two identically constructed limbs 114, 116 oriented at an incline to the longitudinal pump axis 18 and arranged symmetrically in relation to the longitudinal pump axis 18, and an arcuate bridge 118 joining the limbs 114, 116. The bridge 118 lies with surface-to-surface contact against an end face 120 of the pump head 52 facing away from the pump block 40 and has a pressure connection piece 122 passing through the center of it. The pressure connection piece 122 defines an end area of the pressure line 86.

The clamping bracket 112 engages around the pump head 52, the pump block 40 and the support shield 30. This is evident from FIGS. 1 and 2. The free ends of the limbs 114, 116 are each screwed by means of a clamping screw 124 and 126, respectively, to a radially outwardly directed screw receptacle of the guide shield 28. Therefore, by means of the clamping bracket 112, the pump head 52 is acted upon by an axially oriented clamping force, and the pump block 40 and the support shield 30 are clamped between the pump head 52 and the guide shield 28.

Figure 4:
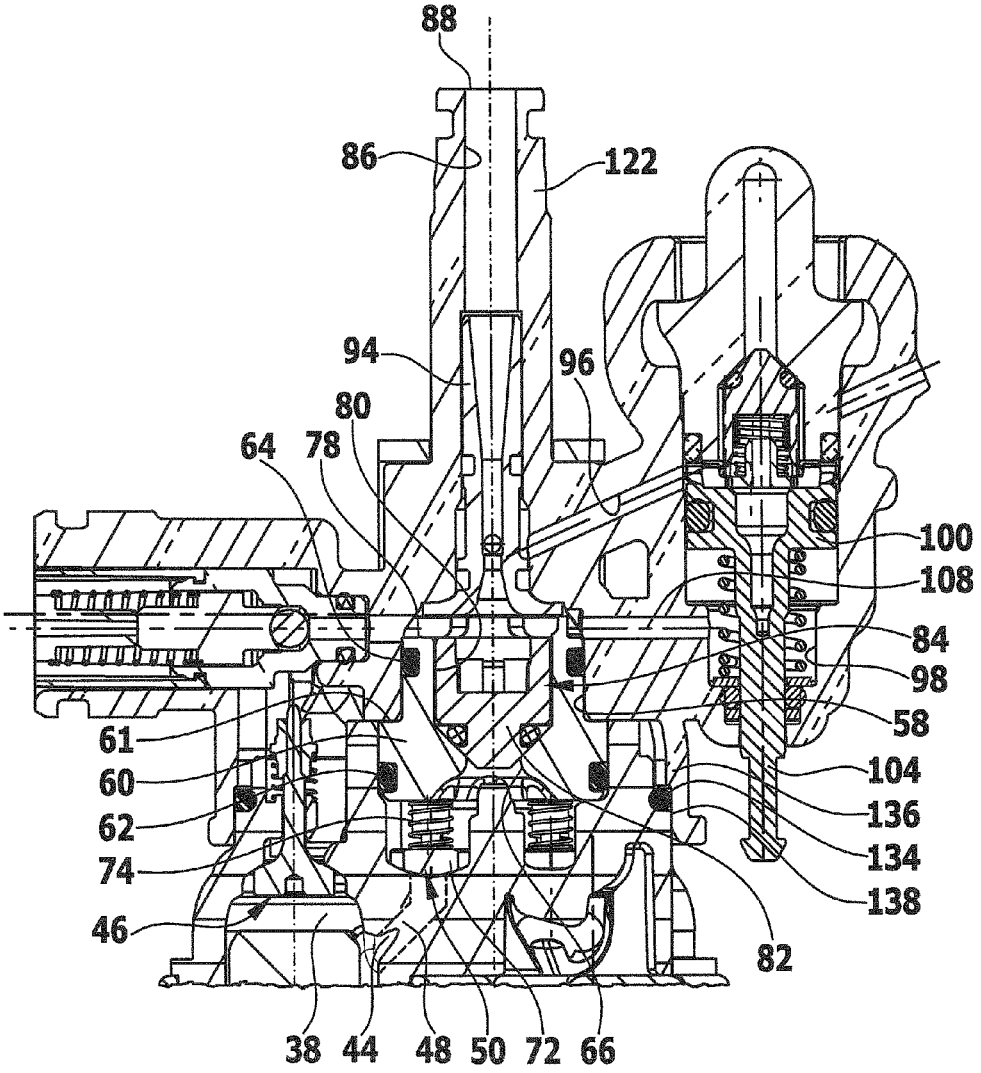
FIG. 4 shows an enlarged partially sectional view of the piston pump in the area of a pump block on which a pump head is fitted.

The pump head 52 is fitted onto the pump block 40 with the interposition of an elastically deformable element in the form of an elastic sealing ring 134. As is evident from FIG. 4, the elastic sealing ring 134 is arranged between a collar-like projection 136 of the pump head 52 and a corresponding support surface 138 of the pump block 40. The elastic sealing ring 134 prevents a rigid connection between the pump head 52 and the pump block 40. The elastic sealing ring 134 exerts an elastic resetting force counter to the clamping force exerted by the clamping bracket 112.

When the piston pump 10 is put into operation, the swash plate 12 rotates about the longitudinal pump axis 18 and the pistons 20 lying against the swash plate 12 are driven reciprocatingly, with the result that the volumes of the pump chambers 38 are periodically altered. Liquid can thereby be drawn into the pump chambers 38 via the suction inlet 54 and discharged via the outlet lines 48, the pressure chamber 58, the central passage 66 of the insert part 60, the pressure line 86 and the pressure outlet 88. During operation of the piston pump 10, the pressure chamber 58 is filled with pressurized liquid upstream of the insert part 60. This liquid acts as a hydraulic pressure ram, which acts upon the pump block 40 with a force which counteracts the pressure forces and torques exerted by the pistons 20. The axially oriented forces are ultimately absorbed by the U-shaped clamping bracket 112. Here pressure peaks that occur may result in a relative movement between the pump head 52 and the pump block 40 as the central insert part 60 is supported by way of its step 61 on the pump head 52 and can, therefore, act upon the pump head 52 with a pressure force. The elastic ring 134 arranged between the pump head 52 and the pump block 40 enables such compensatory movements counter to the action of the clamping force exerted by the clamping bracket 112.

The piston pump 10 is distinguished by relatively low production costs and simple assembly. For assembly, the swash plate housing 14, the guide shield 28, the support shield 30, the pump block 40 and the pump head 52 can be fitted onto one another and then clamped together by means of the clamping bracket 112. For positioning purposes, the clamping bracket 112 can be fitted onto the pressure connection piece 122 which, therefore, allows simple positioning of the clamping bracket 112.

The invention claimed is:

1. A piston pump for a high-pressure cleaning appliance, the piston pump being adapted to pressurize a liquid and comprising a pump block having a plurality of pump chambers, into each of which one piston which is movable back and forth parallel to a longitudinal pump axis plunges, wherein the longitudinal axis intersects a center of a swash plate surface that contacts the pistons, and comprising a pump head fitted on the pump block and having a suction inlet for supplying liquid and a pressure outlet for discharging liquid, each pump chamber being in flow connection via a suction valve with the suction inlet and via a pressure valve with the pressure outlet, and comprising a single U-shaped clamping bracket engaging around the pump head for clamping the pump head to the pump block, the U-shaped clamping bracket being oriented symmetrically in relation to the longitudinal pump axis and comprising two limbs arranged symmetrically in relation to the longitudinal pump axis such that central axes of the two limbs form a plane that includes the longitudinal pump axis, and a bridge joining the limbs, and the pump head and the pump block form between them downstream of the pressure valves a pressure chamber in which a central insert part is arranged, the insert part being formed rotationally symmetrically in relation to the longitudinal pump axis and being surrounded by at least one sealing element and having a passage, and a pressure line oriented coaxially with the longitudinal pump axis being arranged downstream of the passage, wherein the piston pump has a pressure line connection piece which is oriented coaxially with the longitudinal pump axis and passes through the center of the bridge of the clamping bracket and defines an end area of the pressure line.

2. The piston pump in accordance with claim 1, wherein the pressure chamber is constructed rotationally symmetrically in relation to the longitudinal pump axis.

3. The piston pump in accordance with claim 1, wherein the pistons are uniformly distributed around the longitudinal pump axis and are arranged at an identical radial distance from the longitudinal pump axis.

4. The piston pump in accordance with claim 1, wherein the pressure valves each have a pressure valve spring which is supported on the central insert part.

5. The piston pump in accordance with claim 1, wherein the central insert part forms a valve seat on which a closing member of a central check valve is sealingly positionable.

6. The piston pump in accordance with claim 1, wherein the pistons are arranged outside of an axial projection of the central insert part.

7. The piston pump in accordance with claim 1, wherein the central insert part has a pressure surface facing the pump block and the pistons plunging into the pump chambers each have an end face, and wherein the pressure surface of the central insert part is at least three times larger than the end faces of the pistons plunging into the pump chambers.

8. The piston pump in accordance with claim 1, wherein the pump head is adapted to be acted upon in the axial direction by an elastic resetting force which counteracts a clamping force exerted by the clamping bracket.

9. The piston pump in accordance with claim 1, wherein an elastically deformable element is arranged between the pump head and the pump block.

10. The piston pump in accordance with claim 9, wherein the elastically deformable element is configured as a sealing ring.

11. The piston pump in accordance with claim 1, wherein the piston pump has a piston guide device on which the pump block is fitted, the pump block being clamped by means of the clamping bracket between the pump head and the piston guide device.

12. The piston pump in accordance with claim 11, wherein the clamping bracket is releasably connected to the piston guide device.

13. The piston pump in accordance with claim 11, wherein the piston pump has a swash plate with which the pistons interact and which is arranged in a swash plate housing, the piston guide device being fitted on the swash plate housing.

14. The piston pump in accordance with claim 13, wherein the piston guide device has a guide shield which forms a cover for the swash plate housing, and a support shield which is clamped by means of the clamping bracket between the guide shield and the pump block and which supports in the axial direction sealing elements circumferentially surrounding the pistons.

* * * * *